US008002017B2

(12) United States Patent
Hayashi et al.

(10) Patent No.: US 8,002,017 B2
(45) Date of Patent: Aug. 23, 2011

(54) METHOD OF MANUFACTURING A COLLAPSIBLE MOLD

(75) Inventors: Chitoshi Hayashi, Toyama-ken (JP); Tomoaki Ishikuro, Toyama-ken (JP); Taro Yamazaki, Toyama-ken (JP); Mitsuru Wakisaka, Toyama-ken (JP); Tatsunori Sakai, Toyama-ken (JP); Masaya Nomura, Shizuoka-ken (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 12/722,647

(22) Filed: Mar. 12, 2010

(65) Prior Publication Data

US 2010/0247700 A1 Sep. 30, 2010

(30) Foreign Application Priority Data

Mar. 27, 2009 (JP) ..... 2009-079286

(51) Int. Cl.
*B22C 1/00* (2006.01)

(52) U.S. Cl. ..... 164/519; 164/529

(58) Field of Classification Search ..... 164/35, 164/519, 529

See application file for complete search history.

(56) References Cited

U.S. PATENT DOCUMENTS

| | | | | |
|---|---|---|---|---|
| 3,196,505 | A * | 7/1965 | Moren | 164/12 |
| 4,289,191 | A * | 9/1981 | Myllymaki | 164/45 |

FOREIGN PATENT DOCUMENTS

| | | | |
|---|---|---|---|
| JP | 49-2655 | B | 1/1974 |
| JP | 6-36954 | B | 2/1989 |
| JP | 03-281030 | | 12/1991 |
| JP | 2763970 | B | 11/1992 |
| JP | 05-104199 | | 4/1993 |
| JP | 06-015407 | | 1/1994 |
| JP | 2006-007234 | | 1/2006 |

* cited by examiner

*Primary Examiner* — Kuang Lin

(74) *Attorney, Agent, or Firm* — Myers Bigel Sibley & Sajovec, PA

(57) ABSTRACT

In a collapsible mold and a method of manufacturing the same, the collapsible mold has extremely low moisture-absorption properties, does not change in surface properties thereof due to absorption of moisture and swelling, and is storable for a long time without absorbing moisture and swelling. Specifically, the method manufactures a collapsible mold containing at least any of calcium oxide and magnesium oxide. The method includes a step of bringing the collapsible mold into contact with carbon dioxide immediately after a step of burning the collapsible mold or a step of casting the collapsible mold.

3 Claims, 1 Drawing Sheet

METHOD OF MANUFACTURING A COLLAPSIBLE MOLD

CROSS-RELATED APPLICATIONS

This application claims priority from Japanese Patent Application No. 2009-079286; filed Mar. 27, 2009, the disclosure of which is incorporated herein by reference in its entirety.

BACKGROUND OF THE INVENTION

1. Field of the Invention

The present invention relates to a collapsible mold and to a method of manufacturing the same.

2. Description of Related Art

For high pressure die casting, many techniques for casting a product having an undercut have been heretofore devised in which a collapsible core mainly containing sand or salt is used to cast the product, and this then is dissolved and removed after the casting. For the purpose of improving the collapsibility of the core, a method is known in which an alkaline-earth metal compound that swells when reacting with water is added to a material for a core mainly containing a water-soluble component such as a salt (refer to JP 2006-7234 A, for example). However, the core manufactured by mixing hydrated lime (calcium hydroxide), calcined lime (calcium oxide) or the like as the alkaline-earth metal compound needs to be stored in a humidity controlled container. This is because an alkaline-earth metal oxide generated from thermal decomposition of the alkaline-earth metal compound absorbs moisture in the atmosphere and thus swells after molding. In addition, even if the core is stored in a low humidity environment, the core inevitably absorbs moisture and swells. For this reason, the core cannot be stored for a long time. Furthermore, the core, having once absorbed moisture and swelled, has a problem of having such a rough surface that a good casting surface cannot be obtained at the time of casting. Moreover, such a core also has other problems of having decreased strength, and of causing a porosity in a casting due to the re-discharge of moisture at the time of the casting.

Furthermore, investment casting methods including ceramic shell molding and solid molding are used for a precision casting or a glass casting (hereinafter, referred to as a lost-wax mold). One of the methods of manufacturing a mold for investment casting that has been developed involves: molding, by use of a wax copy of an original model (hereinafter, referred to as a wax pattern), a mold composition containing calcium carbonate as a refractory; melting in the mold and draining out the wax pattern (dewaxing); and burning the resultant mold composition (green mold) at a temperature not less than the decomposition temperature of calcium carbonate. When the mold manufactured by this method is used, calcium oxide contained in the mold can be slaked and then turned into calcium hydroxide by immersing the mold in water or leaving the mold to stand in the air after the casting. At this time, the mold self-collapses due to an increase in the volume of the mold, thus making it easier to remove the mold from the casting.

In addition, a method of manufacturing a mold having good air permeability has been devised, focusing on the point where calcium carbonate becomes porous by the thermal decomposition at the time of burning. For example, there is a method of manufacturing a lost-wax mold, involving: preparing a mold containing not less than 10 wt % of calcium carbonate; and after a dewaxing process, turning a part of the calcium carbonate into calcium oxide by burning the mold at a temperature not less than 850° C. (refer to JP 49-2655 B, for example). In addition, a method of manufacturing a lost-wax mold by using fossil shell as a source of calcium carbonate is known (refer to JP 6-36954 B, for example). Since fossil shell is used as the calcium carbonate source, a mold having good collapsibility can be obtained even when the mold is burned at a burning temperature as low as 760° C.

Furthermore, a manufacturing method using a mixture of calcium carbonate or calcium carbonate and a refractory as a filler and using colloidal silica as a binder is known (refer to JP 3-281030 A, for example). According to this method, gelation of a slurry made of the mixture of the calcium carbonate or the calcium carbonate and the refractory is prevented for a long period of time. This facilitates molding of a mold, and at the same time, provides collapsibility after casting. Furthermore, there are known a manufacturing method using a stucco material mixed with 10 to 80 wt % of calcium carbonate (refer to JP 5-104199 A, for example), and a method of manufacturing a mold with good collapsibility by using calcium carbonate in a part of a refractory layer (refer to JP 6-15407 A, for example).

However, the molds manufactured by these methods have a problem in that the mold swells because the calcium oxide generated when calcium carbonate is thermally decomposed at the time of burning of the mold absorbs moisture in the atmosphere and then turns into calcium hydroxide. When the mold swells, the surface roughness increases, the surface dimensional accuracy thereof decreases, and cracks occur in some cases. In addition, the moisture that has been absorbed in the mold is not dissociated from the mold unless the mold is heated to a temperature of not less than 580° C. Thus, unless the mold is heated to or above this temperature before the casting process, the moisture will be dissociated due to the heat of molten metal at the time of casting, thus causing porosities in some cases. Accordingly, the mold must be used in casting immediately after burning or must be stored with humidity sufficiently controlled. In addition, the mold cannot be stored for a long time since the mold inevitably absorbs moisture and swells even in a low humidity environment.

Meanwhile, there is known a technique to prevent a mold from self-collapsing due to the absorption of moisture in the atmosphere, by providing a backup coat layer containing calcium carbonate between an outermost surface coat layer and a face coat layer that is to be in contact with molten metal (refer to JP 2763970 B, for example). However, since both of the outermost surface coat layer and the face coat layer have air permeability, suppression of absorption of moisture of the mold is not sufficient.

SUMMARY OF THE INVENTION

The present invention has been made in view of the aforementioned problems. An object of the present invention is to provide a collapsible mold which has extremely low moisture-absorption properties and thus prevents change in surface properties thereof due to absorption of moisture and swelling, and which is storable for a long period of time without causing absorption of moisture and swelling. Another object of the present invention is to provide a manufacturing method of the collapsible mold.

The present invention has been made to address the aforementioned problems. Specifically, a first aspect of the present invention is a method of manufacturing a collapsible mold containing at least one of calcium oxide and magnesium oxide, the method including a step of bringing the collapsible mold into contact with carbon dioxide immediately after any one of a step of burning the collapsible mold and a step of casting the collapsible mold. The aforementioned step of bringing the collapsible mold into contact with carbon dioxide is preferably performed while the temperature of the collapsible mold is kept at 300° C. or higher after the burning step or the casting step.

In one mode of the method of manufacturing a collapsible mold according to the first aspect, the collapsible mold is a salt core and is preferably made of a material containing at least one of calcium oxide, magnesium oxide, calcium hydroxide and magnesium hydroxide.

In another mode of the method of manufacturing a collapsible mold according to the first aspect, the collapsible mold is a lost-wax casting mold and is preferably made of a material containing at least one of calcium carbonate and magnesium carbonate.

A second aspect of the present invention is a collapsible mold and the collapsible mold is manufactured by the aforementioned method.

A second aspect of the present invention is a collapsible mold including at least one of calcium oxide and magnesium oxide. In the collapsible mold, the calcium oxide and the magnesium oxide in a surface layer thereof are changed into calcium carbonate and magnesium carbonate, respectively. The surface layer of the collapsible mold refers to a region of a surface portion of the collapsible mold, the region having a depth of 1 to 50 μm, or less, from the surface of the collapsible mold.

According to the present invention, it is possible to provide a collapsible mold capable of suppressing its moisture-absorption properties and of being stored for a long period of time, and enabling an improvement in surface properties of a casting. According to the present invention, a method of manufacturing the collapsible mold can also be provided.

DETAILED DESCRIPTION OF THE PREFERRED EMBODIMENTS

Figures 1A, 1B, 1C, 1D:
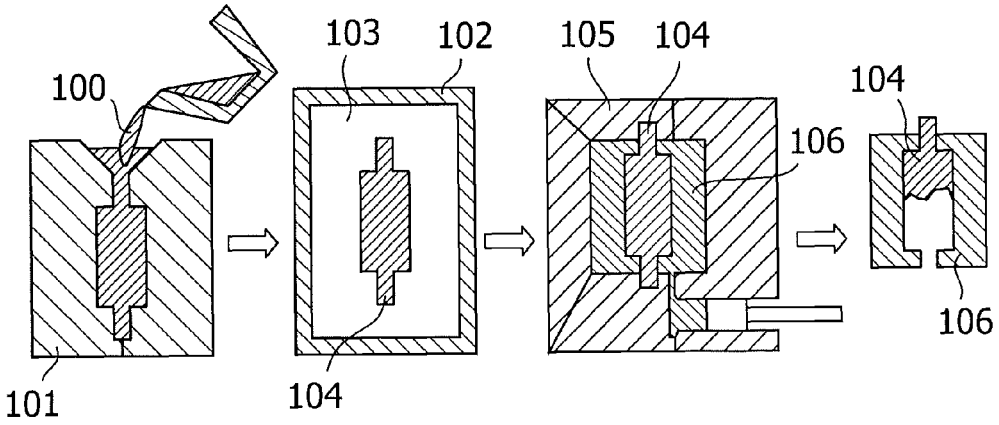
FIGS. 1(*a*) to 1(*d*) are diagrams for illustrating a flow of manufacturing a core of the present invention and of using the core.

The present invention now will be described more fully hereinafter in which embodiments of the invention are provided with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs.

Hereinafter, a description will be given in more detail of a collapsible mold according to the present invention and a method of manufacturing the same. Note that, the present invention is not limited to the embodiments to be described below.

The method of manufacturing a collapsible mold according to the present invention is a method of manufacturing a collapsible mold containing at least one of calcium oxide and magnesium oxide. The method includes a step of bringing the collapsible mold into contact with carbon dioxide immediately after a burning step or a casting step of the collapsible mold.

Embodiment 1

Manufacturing Method of Salt Core

Hereinafter, a description will be given of a method of manufacturing a collapsible mold according to the present invention in a case in which the collapsible mold is a salt core. The manufacturing method of a salt core includes the steps of: melting and producing a mold composition; casting a salt core; and bringing the salt core into contact with carbon dioxide. A salt core is cast by the steps of: melting and producing a mold composition; and casting the mold composition.

Step of Melting and Producing Mold Composition

In the step of melting and producing a mold composition for a salt core, materials containing salt which is to be melted, an alkaline-earth metal compound, and a refractory are mixed. As the alkaline-earth metal compound, calcium hydroxide, magnesium hydroxide, calcium oxide and magnesium oxide are preferable.

As the salt, a salt such as sodium chloride, potassium chloride, sodium sulfate, potassium sulfate, sodium carbonate, potassium carbonate, sodium nitrate, potassium nitrate, or a mixture thereof can be used. The salt is blended so as to be 60 to 80 vol % of the mold composition. The salt is melted by heating the salt to a temperature not less than a previously measured liquidus-line temperature of mixed salt. A crucible melting furnace or the like can be used for melting the salt. The alkaline-earth metal compound, refractory and other components can be mixed before the melting of the salt. The components other than the alkaline-earth metal compound can also be mixed after the melting of the salt.

As the alkaline-earth metal compound, one of, or a mixture of at least two selected from calcium oxide, magnesium oxide, calcium hydroxide and magnesium hydroxide may be used. The calcium oxide, magnesium oxide, calcium hydroxide and magnesium hydroxide are blended in the mold composition so that the alkaline-earth metal oxide generated after these substances are thermally decomposed can be 5 to 20 vol % of the mold composition. The content of the alkaline-earth metal compound of less than 5 vol % may result in insufficient collapsibility in some cases. On the other hand, the content of the alkaline-earth metal compound exceeding 20 vol % sometimes makes it difficult to remove the core from the inside of the product since the swelling degree of the core is significant with this ratio.

As the refractory, mullite, alumina, zircon or the like can be used. The refractory is blended in the mold composition so that the sum of the content of the refractory and that of the alkaline-earth metal compound can be 20 to 40 vol % of the mold composition. When the sum of the content of the refractory and that of the alkaline-earth metal compound is less than 20 vol %, the core lacks the strength, and may form a wrinkle on its surface in some cases. On the other hand, when the sum of the content of the refractory and that of the alkaline-earth metal compound exceeds 40 vol %, the fluidity of the melted salt is reduced, and this may make it difficult to cast the core in some cases. Furthermore, as an additional component, copper or copper alloy powders, graphite and the like may be mixed in the mold composition. A general amount of the additional component may be blended in accordance with its purpose, provided such blending does not impair the objects and effects of the present invention. For example, graphite may be mixed in the mold composition so that the sum of the content of the graphite and those of the refractory and the alkaline-earth metal compound can be 20 to 40 vol % of the mold composition.

Casting Step

In the step of casting the mold composition, the mold composition melted in the aforementioned manner (denoted by reference numeral 100 in FIG. 1) is cast by being poured into a dies such as metallic molds (denoted by reference numeral 101 in FIG. 1). When the mold composition is solidified, the compact is removed from the dies. The casting step for the salt core ends with the aforementioned steps (FIG. 1, (*a*)).

In the casting step, when heated to a high temperature, calcium hydroxide decomposes into calcium oxide, and magnesium hydroxide decomposes into magnesium oxide. For example, calcium hydroxide decomposes into calcium oxide at 580° C., and magnesium hydroxide decomposes into magnesium oxide between 330 and 430° C. Accordingly, in the salt core after the casting, approximately 100 percent of calcium hydroxide and magnesium hydroxide are in a state of having been decomposed into calcium oxide and magnesium oxide, respectively, in a case in which the calcium hydroxide and magnesium hydroxide are heated to or above the respective decomposition temperatures. Calcium oxide and magnesium oxide absorb moisture and cause volume expansion, thereby making the mold self-collapsible and allowing the mold to be easily removed from the casting.

Carbon Dioxide Treatment Step

In the step of bringing the salt core after the casting into contact with carbon dioxide (hereinafter, referred to as a carbon dioxide treatment step) (refer to FIG. 1(*b*)), a treatment of reforming the surface layer of the salt core is performed by exposing the salt core obtained by the aforementioned casting in a carbon dioxide atmosphere (denoted by reference numeral 103 in FIG. 1(*b*)) with the salt core kept at the high temperature. The carbon dioxide treatment step is performed immediately after the casting step. The timing immediately after the casting step means the period during which the salt core is kept at a high temperature not less than 300° C. after the casting step is performed, that is, after the solidified salt core is removed from the dies.

After the casting step, the carbon dioxide treatment step is preferably performed while the salt core has a temperature of not less than 300° C., and is more preferably performed while the salt core has a temperature of 580 to 650° C. Theoretically, the carbon dioxide treatment step is preferably performed while the salt core has a temperature of not less than 580° C. at which the generation of calcium hydroxide due to the absorption of moisture is impossible, or a temperature of not less than 330° C. at which the generation of magnesium hydroxide due to the absorption of moisture is impossible. However, practically, even when the temperature falls below 580° C., the temperature of not less than 300° C. is still sufficient for reforming the surface layer of the salt core as long as the carbon dioxide treatment step is performed immediately after the salt core is removed from the dies, i.e., before the salt core absorbs moisture in the atmosphere. This is inferred to be due to the fact that the temperature of below 580° C. is still sufficient for forming calcium carbonate and magnesium carbonate as long as the carbon dioxide treatment step is performed before the adsorption of moisture in the atmosphere progresses. Accordingly, even if the temperature of the salt core is below 580° C. when the salt core is removed from the dies, the salt core may be subjected to the carbon dioxide treatment as long as the salt core is sent to this step before the absorption of moisture in the air, for example, within one minute after the removal from the dies. Even if hydroxide is generated during this period, the hydroxide can be carbonated during the carbon dioxide treatment step to be performed later.

The carbon dioxide to be brought into contact with the salt core can be set at room temperature. Alternatively, the carbon dioxide may have a temperature of not less than the dew point of its atmosphere. When the carbon dioxide has a temperature of less than the dew point of its atmosphere, the carbon dioxide may contain moisture in some cases. The carbon dioxide treatment step is preferably performed for approximately one hour. The salt core is naturally cooled down to the temperature of the carbon dioxide while being in contact with the carbon dioxide.

In the carbon dioxide treatment step, instead of carbon dioxide, a gas obtained by mixing dry nitrogen or the like with carbon dioxide can be used. The carbon dioxide is injected and filled into a heat-resistant glove box (denoted by reference numeral 102 in FIG. 1B), for example. A partial pressure of the carbon dioxide to be brought into contact with the salt core is preferably not less than 0.005 atm, and more preferably 0.2 to 0.5 atm. When the partial pressure of the carbon dioxide is below 0.005 atm, the surface layer of the salt core may not be sufficiently reformed by the carbon dioxide in some cases. Conversely, when the partial pressure of the carbon dioxide is higher than 0.5 atm, an excessive amount of the carbon dioxide may be discharged into the atmosphere in some cases.

According to the carbon dioxide treatment step, calcium oxide and magnesium oxide exist in the surface layer of the salt core are carbonated and can be changed into calcium carbonate and magnesium carbonate, respectively. The surface layer reformed in this manner has a thickness of 1 to 50 μm. Calcium carbonate and magnesium carbonate have properties of not absorbing moisture and of being stable at the respective decomposition temperatures or less. Thus, the calcium carbonate and magnesium carbonate in the surface layer can function as a protection film for preventing the mold from absorbing moisture.

Figure 2:
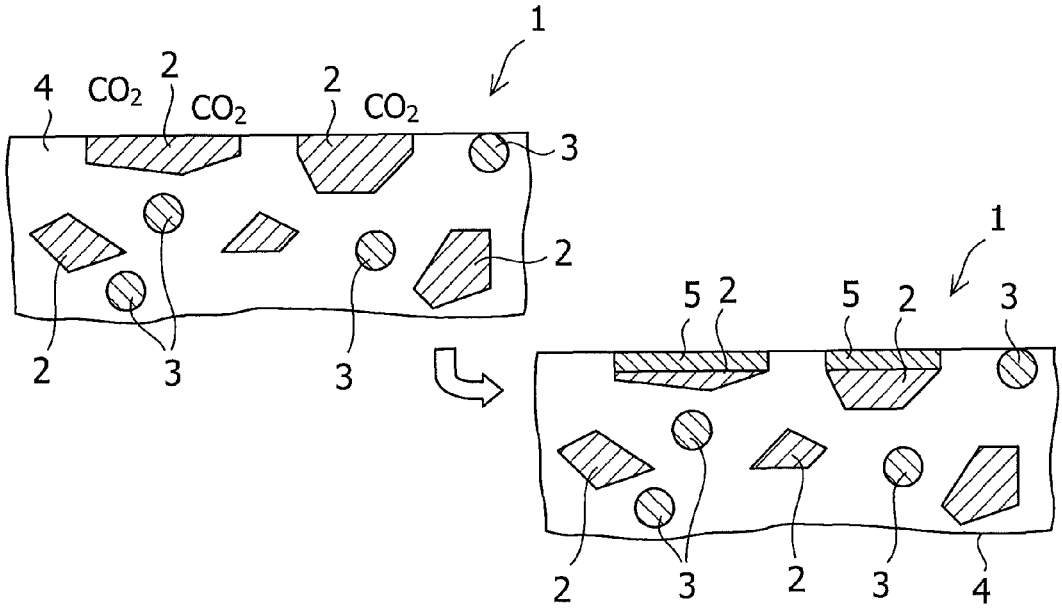
FIG. 2 is a diagram for illustrating changes of a surface layer of the collapsible core of the present invention due to a carbon dioxide treatment step.

FIG. 2 shows changes in a surface layer portion of the salt core due to the carbon dioxide treatment step. A salt core 1 contains calcined lime 2, refractory 3 and salt 4 as its components. Upon execution of the carbon dioxide treatment step with the salt core 1 being brought into contact with carbon dioxide, the calcined lime 2 which exist in the surface layer of the salt core 1 and the carbon dioxide react with each other, and then, calcium carbonate 5 is generated. Accordingly, the calcined lime 2 in the surface layer of the salt core 1 is changed into the calcium carbonate 5 and exists in the salt core 1.

With reference to FIG. 1(*c*), in the casting step (FIG. 1(*c*)) using the core according to the present invention, a core 104 manufactured in the aforementioned manner is placed inside a die 105. Next, molten metal is injected into a cavity formed in the dies 105, and then the dies 105 is pressurized. Subsequently, after a casting 106 is taken out of the die 105, a step of removing the core 104 from the casting 106 (FIG. 4(*d*)) is performed. The core 104 can be removed by being immersed in water or by absorbing moisture in the air. When the core 104 absorbs moisture, the core 104 swells and collapses, so that the core 104 can be easily removed from the casting 106.

As shown in FIGS. 1(*a*) to 1(*d*), since the carbon dioxide treatment step (1*b*) is performed after the core casting step (1*a*), the equipment used for these two steps can be made compact. Moreover, when equipment having a large capacity is used for the carbon dioxide treatment step (1*b*), the equipment can also be used for the core storage purpose. This equipment can store therein a certain amount of cores to be required while performing the carbon dioxide treatment step. Accordingly, the equipment used for the carbon dioxide treatment step (1*b*) can also function like a buffer to store cores until the cores are used in the casting step, when the core casting step (1*a*), the carbon dioxide treatment step (1*b*) and the casting step using the core (1*c*) are performed in this order. As described above, the equipment used for the carbon dioxide treatment step (1*b*) can be used as a storage as well, so that an integrated manufacturing line can be achieved when the equipment used for the core casting step (1*a*), the carbon dioxide treatment step (1*b*) and the casting step using the core (1*c*) are arranged adjacent to one another. This makes it possible to increase production efficiency.

Embodiment 2

Lost-Wax Casting Mold

Next, a description will be given of a manufacturing method of a collapsible mold according to Embodiment 2 of the present invention in a case in which the collapsible mold is a lost-wax casting mold. The manufacturing method according to this embodiment includes the steps of: preparing a mold composition; molding the mold composition; burning a compact; and treating the resultant compact with carbon dioxide.

Step of Preparing Mold Composition

In the step of preparing a mold composition, materials containing a refractory, a binder and at least one of calcium carbonate and magnesium carbonate are mixed.

As to calcium carbonate and magnesium carbonate, one of these substances, or a mixture of these substances may be used. Calcium carbonate and magnesium carbonate are preferably mixed so as to be 5 to 75 percent by weight of the mold composition. When the content of these substances is less than 5 percent by weight, a sufficient collapsibility may not be obtained in some cases. On the other hand, when the content of these substances exceeds 75 percent by weight, a dimensional accuracy may be reduced due to shrinkage at the time of burning in some cases.

As the refractory, chamotte, mullite, alumina, silica, zircon, stabilized zirconia or the like can be used. As the binder, colloidal silica, ethyl silicate, zirconia sol or the like can be used. The binder can be mixed with a filler to have an appropriate viscosity, the filler being a part of the mold composition. Furthermore, as an additional component, glass fiber, gypsum, chromium oxide or the like may be mixed in the mold composition. The additional component may be mixed in general concentration in accordance with its purpose, provided such mixing does not impair the objects and effects of the present invention. A slurry mixer or the like can be used in preparation of slurry formed of the mold composition.

Molding Step

In the step of molding the mold composition, the mold composition is molded by arranging a frame around a wax pattern, and then pouring slurry formed of the mold composition into the frame, and then drying the mold composition. Alternatively, the mold composition may be molded by using other general techniques. In this step, a lost foam pattern made of a polystyrene foam, styrene or the like may be used instead of the wax pattern.

In addition, in this step, a step of forming a coat layer may also be performed. The step of forming a coat layer is performed at least twice. The step of forming a coat layer includes the steps of: forming a slurry layer formed of the mold composition around the wax pattern; and causing a stucco material to adhere to the slurry layer and then drying the slurry layer. The step of forming the slurry layer is performed by immersing the wax pattern in the slurry, for example.

Alternatively, as another mode of this embodiment, this step can be performed by using two kinds of slurry including: first slurry containing at least one of calcium carbonate and magnesium carbonate; and second slurry containing neither calcium carbonate nor magnesium carbonate. Specifically, this step includes the steps of: forming a first coat layer; and forming a second coat layer. Each of the steps of forming the first and second coat layers is performed at least once. In a case in which the steps are performed multiple times, it is preferable to form the first coat layer as the innermost layer and to form the second coat layer as the outermost layer. The step of forming the first coat layer includes the steps of: forming a first slurry layer around the wax pattern; and causing a stucco material to adhere to the first slurry layer and then drying the first slurry layer. The step of forming the second coat layer includes the steps of: forming a second slurry layer around the first coat layer; and causing a stucco material to adhere to the second slurry layer and then drying the second slurry layer. In a case in which a stucco material adheres to the second slurry layer formed outermost, a step of forming the second slurry layer and drying the second slurry layer may be performed for the purpose of preventing separation of the stucco material.

As the first slurry, a mold composition containing a refractory such as mullite, fused silica, alumina or zircon, a binder such as colloidal silica or ethyl silicate, and at least one of calcium carbonate and magnesium carbonate can be used. The first coat layer formed by use of the first slurry is brought into direct contact with molten metal at the time of casting and then forms a casting surface. The first coat layer is superior in air permeability and has properties to absorb moisture and then swell after the casting, thereby enabling easier removal of the mold. As the second slurry, a mold composition containing a refractory such as mullite, fused silica, alumina or zircon and a binder such as colloidal silica, ethyl silicate or zirconyl acetate can be used. The second coat layer formed by use of the second slurry is excellent in air permeability and has properties to provide strength sufficient to bear stress acting thereon at the time of the casting. As described above, the use of the two kinds of coat layers yields advantageous effects including: providing a good fluidity of molten metal since the layers are excellent in air permeability; enabling easier removal of the mold due to the self-collapsible surface layer portion of the mold; providing resistance to spalling; and providing strength sufficient to bear manufacturing of a large casting.

Moreover, due to the properties of the casting, the second coat layer not containing calcium carbonate or the like may be formed as the innermost layer, which comes into direct contact with the casting surface, in some cases. For example, a mold for casting titanium alloy cannot contain silicon, which reacts with titanium, as its innermost layer coming into contact with the casting. Accordingly, instead of using a binder containing silicon, such as colloidal silica or ethyl silicate, a binder not containing silicon, such as zirconyl acetate, is preferably used in preparation of slurry for forming the innermost layer. However, when zirconyl acetate is mixed with calcium carbonate, the calcium carbonate dissolves while generating carbon dioxide, and in the meantime zirconium compound is precipitated, so that the viscosity of the slurry increases significantly. For this reason, zirconyl acetate is not suitable for the binder of the slurry containing calcium carbonate. Accordingly, regarding the mold for casting titanium alloy, it is preferable that no calcium carbonate be mixed in the slurry for forming the innermost layer, and therefore the second slurry not containing calcium carbonate or the like is used to form the innermost layer. In addition, titanium alloy is highly reactive at a high temperature, and thus may react with calcium oxide in some cases. Accordingly, in a case in which calcium carbonate is contained in the innermost layer of the mold for casting titanium alloy, the mold may not swell even when the mold is brought into contact with moisture after the casting in some cases. This is because calcium oxide generated due to burning of the mold reacts with titanium in the molten metal and changes into another substance. From this point as well, it is preferable that no calcium carbonate be mixed in the slurry for forming the innermost layer of the mold for casting titanium alloy. The first slurry containing calcium carbonate or the like can be used for forming an outer side layer not coming into direct contact with the casting. The use of calcium carbonate in the outer side layer can provide self-collapsibility to the mold. Note that, when zirconyl acetate is used as the binder for the innermost layer, the zirconyl acetate is thermally decomposed and becomes porous due to burning, so that air permeability of the innermost layer can be secured. It should be noted that the concept of the term described as "mold for casting titanium alloy" in the statement of this description and scope of claims does not exclude a mold for casting pure titanium.

Dewaxing Step

A step of removing (dewaxing) a lost foam pattern such as a wax pattern is performed after the step of molding the mold composition. The dewaxing step can be executed by a general method and is not limited in particular. The dewaxing step is performed by, for example, melting in the mold and draining out the wax pattern by pressurizing and heating the wax pattern with water vapor by use of an autoclave, or putting the lost foam pattern in a high temperature furnace and then burning the lost foam pattern.

Burning Step

The burning step is executed by heating a compact of the mold composition to a temperature of 800 to 1200° C. The heating time can be one to two hours. The burning step is preferably performed in the air atmosphere. A baking furnace or the like can be used for burning. In the burning step, calcium carbonate and magnesium carbonate are thermally decomposed into calcium oxide and magnesium oxide, respectively. Since calcium oxide and magnesium oxide absorb moisture and then causes volume expansion, self-collapsibility is provided to the mold, thereby enabling easier removal of the mold.

Carbon Dioxide Treatment Step

In the carbon dioxide treatment step, a step of reforming the surface layer of the mold is performed by exposing the burned mold with a high temperature in a carbon dioxide atmosphere. The carbon dioxide treatment step is performed immediately after the burning step. The timing immediately after the burning step means the period during which the mold is kept at a high temperature not less than 300° C. after the burning step. The carbon dioxide treatment step is preferably performed when the temperature of the mold is not less than 300° C. after the burning step. More preferably, the carbon dioxide treatment step is performed when the temperature of the mold is between 580 and 650° C. Typically, the burning step for a lost-wax casting mold is performed at a high temperature not less than 800° C. in many cases. Accordingly, if the process proceeds to the carbon dioxide treatment step immediately after the burning step, the carbon dioxide treatment can be performed while the mold is kept at a high temperature not less than 580° C. Thereby, reformation of the surface layer can be performed sufficiently.

According to the carbon dioxide treatment step, the calcium oxide and magnesium oxide existing in the surface layer can be changed into calcium carbonate and magnesium carbonate, respectively. In a case in which a stucco material adheres to the surface of the mold, the surface layer of the layer formed as a result of burning the slurry layer to which the stucco material adheres is reformed. The surface layer reformed in this manner has a thickness of 1 to 50 μm. The calcium carbonate and magnesium carbonate in the surface layer function as a protection film for preventing absorption of moisture by the mold and enables long-term storage of the mold while the self-collapsibility of the mold is maintained.

Attributes of Collapsible Mold

The collapsible mold of the present invention manufactured in the aforementioned manner is mainly composed of at least one of calcium oxide and magnesium oxide and is characterized in that the calcium oxide and magnesium oxide in the surface layer are carbonated and changed into calcium carbonate and magnesium carbonate, respectively. The thickness of the surface layer is within a range from 1 to 50 μm. When the thickness of the surface layer is less than 1 μm, the function of the surface layer as the protection film is not sufficient, so that absorption of moisture of the collapsible mold cannot be prevented in some cases. The collapsible mold of the present invention as a finished product contains 5 to 75 percent by weight of calcium oxide and magnesium oxide. When the content of the calcium oxide and magnesium oxide is less than 5 percent by weight, collapsibility of the mold may not be sufficient in some cases. On the other hand, when the content of the calcium oxide and magnesium oxide exceeds 75 percent by weight, dimensional accuracy of the mold may be reduced in some cases due to shrinkage of the mold at the time of burning. The collapsible mold may contain one of or both of calcium oxide and magnesium oxide.

The collapsible mold of the present invention as a finished product contains 25 to 95 percent by weight of refractory such as mullite, fused silica, alumina or zircon. The content of the refractory less than 25 percent by weight may be disadvantageous in some cases in terms of a reduction in dimensional accuracy and insufficient strength of the mold. On the other hand, the content of the refractory exceeding 95 percent by weight may be disadvantageous in some cases in terms of insufficient collapsibility of the mold.

The collapsible mold may contain glass fiber, calcium sulfate, chromium oxide or the like as another structural component in some cases.

The collapsible mold of the present invention is a collapsible core or mold and swells by absorbing moisture and then collapses. The collapsible mold according to the present invention may be a mold for solid molding in addition to a salt core and a lost-wax casting mold.

In the collapsible mold of the present invention, the calcium oxide and magnesium oxide in the surface layer are carbonated and changed into calcium carbonate and magnesium carbonate, respectively, so that the calcium oxide and magnesium oxide existing inside the mold are blocked from coming into contact with the atmosphere. Thus, the calcium carbonate and magnesium carbonate existing in the surface layer of the mold function as the protection film, so that the calcium oxide and magnesium oxide existing inside the collapsible mold can be prevented from absorbing moisture in the atmosphere. Accordingly, absorption of moisture of the mold is suppressed, thus enabling long-term preservation of the mold.

In addition, alkaline-earth metal oxide such as calcium oxide contained in the mold does not swell due to absorption of moisture during the storage period. Accordingly, roughening of the surface of the mold does not occur, thereby achieving a good casting surface. Moreover, cracks in the mold due to absorption of moisture and swelling of the mold do not occur, so that the strength of the mold can be maintained. Furthermore, a porosity because of re-discharge of moisture absorbed by the mold at the time of casting also does not occur.

Hereinafter, a specific description of the present invention will be given with examples and comparative examples. However, the collapsible mold and the method of manufacturing the same according to the present invention are not limited to the examples below.

Examples

Casting Core; Salt Core

A mold composition was prepared by mixing 27.8 percent by weight of NaCl, 34.7 percent by weight of KCl, 11.2 percent by weight of mullite and 26.3 percent by weight of lime hydrate. The mold composition was melted by being heated to 750° C. and then poured into dies for molding cores. The cores were removed from the dies and exposed in carbon dioxide atmospheres at temperatures of 500° C., 400° C. and 300° C., respectively. Then, the cores in the atmospheres were naturally cooled to room temperature. Moreover, another core subjected to casting at the same time was naturally cooled in the atmosphere and thereafter exposed to a carbon dioxide atmosphere at room temperature. These cores were stored in a low humidity container (room temperature, 40% humidity) for 2 days or 30 days. Thereafter, the surface states of the cores were compared by using a stereomicroscope.

The result of the comparison is shown in Table 1. In the case in which the carbon dioxide treatment was performed at room temperature, a change that a minute crack occurred due to swelling of calcium oxide was observed on the surface of the core after 30 days of storage, and thus it was confirmed that the core had absorbed moisture. In contrast to this, in the case in which the carbon dioxide treatment was performed at the temperatures of 300° C., 400° C. and 500° C., no change was observed on the surface of the core even after 30 days of storage, and thus it was confirmed that the core had absorbed no moisture. As described, it was confirmed that execution of the carbon dioxide treatment at a temperature not less than 300° C. provides the effect of preventing absorption of moisture.

TABLE 1

| Carbon dioxide treatment temperature | Absorption of moisture on surface of core | |
|---|---|---|
| | 2 days of storage | 30 days of storage |
| 500° C. | Not observed | Not observed |
| 400° C. | Not observed | Not observed |
| 300° C. | Not observed | Not observed |
| Room temperature | Not observed | Observed |

Precision Casting Mold 1; Aluminum Alloy Mold

A mixture of 70 percent by weight of fossil shell powders with a grain size of 325 mesh or less and 30 percent by weight of mullite, serving as the filler, was mixed with colloidal silica. Thereby, primary slurry and secondary slurry were prepared. The primary slurry was prepared so as to have a viscosity of 40 to 50 seconds (Zahn cup #5). The secondary slurry was prepared so as to have a viscosity of 25 to 330 seconds (Zahn cup #4).

A degreased wax pattern was immersed in the primary slurry. Then, fossil shell having a grain size of 10 to 48 mesh adhered as a stucco material to the wax pattern that has been coated with the slurry, and the primary slurry was then dried. Next, the wax pattern was immersed in the secondary slurry, and fossil shell adhered as a stucco material to the wax pattern, and the secondary slurry was then dried. After three layers were formed by repeating this step, it was immersed in the secondary slurry. Then, chamotte having a grain size of 10 to 48 mesh adhered as a stucco material to the secondary slurry, and the slurry was then dried. Then, three layers were formed by repeating this step. After the slurry was dried, it was further immersed in the secondary slurry and was then dried. Thus, the coating was ended.

Next, the wax pattern was removed by being molten and drained by use of an autoclave. Thereafter, molds thus formed were burned for two hours at a temperature of 850° C. Thereafter, the mold was immediately moved to a container filled with carbon dioxide at a temperature of approximately 40° C. and was then naturally cooled down to room temperature for approximately one hour. Subsequently, the mold was stored in a low humidity container (room temperature, 40% humidity). In addition, another mold burned at the same time was cooled down in the atmosphere to room temperature, and the mold was subsequently exposed in a carbon dioxide atmosphere. The mold was then stored in a low humidity container (room temperature, 40% humidity). Table 2 shows the result of comparison between the surface states of castings manufactured by preheating the molds manufactured in the aforementioned manners, respectively, to a temperature of approximately 300° C., and by casting molten aluminum (AC4C) at a temperature of approximately 700° C. by use of the molds.

In the case in which the mold was subjected to the carbon dioxide treatment immediately after the burning, no porosity was observed in the surfaces of both of the castings stored for 2 days and 30 days. On the other hand, in the case in which the mold was cooled down to room temperature after the burning and was then subjected to the carbon dioxide treatment, it was confirmed that porosities occurred on the surface of the casting when the mold stored for 30 days was used. As described, the execution of the carbon dioxide treatment immediately after the burning can suppress absorption of moisture of the mold and prevent porosities on the surface of the casting.

TABLE 2

| | Porosity on surface of casting | |
|---|---|---|
| | 2 days of storage | 30 days of storage |
| Execution of carbon dioxide treatment immediately after burning | Not observed | Not observed |
| Execution of carbon dioxide treatment after cooling of mold to room temperature | Not observed | Observed |

Precision Casting Mold 2; Glass Casting Mold

Primary slurry was prepared by using chromium dioxide having a grain size of 325 mesh or less as the filler and by mixing zirconyl acetate with the chromium dioxide. Secondary slurry was prepared by using as the filler a mixture of 70 percent by weight of fossil shell powders having a grain size of 325 mesh or less and 30 percent by weight of mullite and by mixing colloidal silica with the mixture. The primary slurry was prepared so as to have a viscosity of 40 to 50 seconds (Zahn cup #5). The secondary slurry was prepared so as to have a viscosity of 25 to 330 seconds (Zahn cup #4).

After a degreased wax pattern was immersed in the primary slurry and was then dried, the wax pattern was immersed in the primary slurry again. Then, fossil shell having a grain size of 10 to 48 mesh adhered as a stucco material to the slurry coated wax pattern and was then dried. Next, the wax pattern was immersed in the secondary slurry, and fossil shell adhered as a stucco material to the wax pattern and was then dried. Two layers were formed by repeating the aforementioned step. Subsequently, two layers were formed by repeating the step of adhering alumina having a grain size of 10 to 48 mesh as a stucco material to the wax pattern after immersing the wax pattern in the secondary slurry. Then, after drying, the wax pattern was further immersed in the secondary slurry and was then dried. Thus, the coating step was ended. Next, the wax pattern was removed by being molten by use of an autoclave. Then, molds thus formed were burned for two hours at 850° C. Then, the mold was immediately moved into a container filled with carbon dioxide at a temperature of approximately 40° C. Then, the mold was naturally cooled for approximately one hour to normal temperature. Then, the mold was stored in a low humidity container (room temperature, 40% humidity). In addition, another mold burned at the same time was cooled down to normal temperature in the atmosphere and was subsequently exposed to a carbon dioxide atmosphere. Then, the mold was stored in a low humidity container. The molds manufactured in the above manners were stored in a low humidity container (room temperature, 40% humidity). Table 3 shows the result of comparison between the surface states of the molds by using a stereomicroscope.

In the mold that has been subjected to the carbon dioxide treatment immediately after the burning, no cracks due to absorption of moisture of the mold were observed even after 30 days of storage. In contrast to this, in the mold that was cooled down to normal temperature after the burning and then subjected to the carbon dioxide treatment, cracks on the surface of the mold were observed. As described, the execution of the carbon dioxide treatment immediately after the burning step can prevent a crack in a mold due to absorption of moisture of the mold.

TABLE 3

| | Cracking of mold due to absorption of moisture | |
|---|---|---|
| | 2 days of storage | 30 days of storage |
| Execution of carbon dioxide treatment immediately after burning | Not observed | Not observed |
| Execution of carbon dioxide treatment after cooling of mold to room temperature | Not observed | Observed |

Precision Casting Mold 3; Titanium Alloy Casting Mold

Primary slurry was prepared by using yttria-stabilized zirconia having a grain size of 325 mesh or less as the filler and then by mixing zirconyl acetate with the yttria-stabilized zirconia. Secondary slurry was prepared by using as the filler a mixture of 70 percent by weight of fossil shell powders having a grain size of 325 mesh or less and 30 percent by weight of mullite and by mixing colloidal silica with the mixture. The primary slurry was prepared so as to have a viscosity of 40 to 50 seconds (Zahn cup #5). The secondary slurry was prepared so as to have a viscosity of 25 to 330 seconds (Zahn cup #4).

A degreased wax pattern was immersed in the primary slurry, and then, yttria-stabilized zirconia having a grain size of 10 to 48 mesh adhered as a stucco material to the slurry-coated wax pattern and was then dried. After three layers were formed by repeating the aforementioned step, three layers were formed by immersing the wax pattern in the secondary slurry and using alumina having a grain size of 10 to 48 mesh as a stucco material. The wax pattern was then dried. Then, the wax pattern was further immersed in the secondary slurry and was then dried. Thus, the coating step was ended. Next, the wax pattern was removed by being molten by use of an autoclave. Then, molds thus formed were burned for two hours at a temperature of 1100° C. Immediately thereafter, the mold was naturally cooled for approximately one hour to normal temperature in a container filled with carbon dioxide at a temperature of approximately 40° C. Then, this mold was stored in a low humidity container (room temperature, 40% humidity). In addition, another mold burned at the same time was cooled in the atmosphere to normal temperature and was subsequently exposed at normal temperature in a carbon dioxide atmosphere. Thereafter, the mold was stored in a low humidity container (room temperature, 40% humidity). The molds manufactured in the above manners were stored in a low humidity container. Table 4 shows the result of comparison between the surface states of the molds by using a stereomicroscope.

On the mold that has been subjected to the carbon dioxide treatment immediately after the burning step at 1100° C. was performed, no crack due to adsorption of moisture by the mold was observed even after 30 days of storage. In contrast, in the mold that was cooled to normal temperature after the burning and was then subjected to the carbon dioxide treatment, cracks due to adsorption of moisture by the mold was observed on the surface after 30 days of storage. As described, the execution of the carbon dioxide treatment immediately after the burning can prevent cracks in the titanium alloy casting mold due to absorption of moisture.

TABLE 4

| | Cracking of mold due to absorption of moisture | |
|---|---|---|
| | 2 days of storage | 30 days of storage |
| Execution of carbon dioxide treatment immediately after burning | Not observed | Not observed |
| Execution of carbon dioxide treatment after cooling of mold to room temperature | Not observed | Observed |

The collapsible mold and the method of manufacturing the same according to the present invention can provide a collapsible mold which prevents change in surface properties thereof due to absorption of moisture and swelling, and which is also storable for a long period of time without resulting in absorption of moisture and swelling.

The entire contents described in the description, drawings, abstract and scope of claims in Japanese Patent Application No. 2009-079286 are incorporated herein by reference as a part of this description.

Having thus described certain embodiments of the present invention, it is to be understood that the invention defined by the appended claims is not to be limited by particular details set forth in the above description as many apparent variations thereof are possible without departing from the spirit or scope thereof as hereinafter claimed. The following claims are provided to ensure that the present application meets all statutory requirements as a priority application in all jurisdictions and shall not be construed as setting forth the full scope of the present invention.

What is claimed is:

1. A method of manufacturing a collapsible mold containing at least one of calcium oxide and magnesium oxide, the method comprising:

one of a step of burning the collapsible mold or a step of casting a molding composition to form the collapsible mold, and immediately thereafter, a step of bringing the collapsible mold into contact with carbon dioxide having a partial pressure of not less than 0.005 atm while the collapsible mold is kept at a temperature of 300° C. or higher.

2. The method of manufacturing a collapsible mold according to claim 1, wherein the collapsible mold is a salt core and is made of a material containing at least one of calcium oxide, magnesium oxide, calcium hydroxide and magnesium hydroxide.

3. The method of manufacturing a collapsible mold according to claim 1, wherein the collapsible mold is a lost-wax casting mold and is made of a material containing at least one of calcium carbonate and magnesium carbonate.

* * * * *